US007148614B2

(12) United States Patent
Kim

(10) Patent No.: US 7,148,614 B2
(45) Date of Patent: Dec. 12, 2006

(54) ELECTRON GUN FOR CATHODE RAY TUBE

(75) Inventor: Dong-Young Kim, Kumi (KR)

(73) Assignee: LG. Philips Displays Korea Co., Ltd., Kumi (KR)

( * ) Notice: Subject to any disclaimer, the term of this patent is extended or adjusted under 35 U.S.C. 154(b) by 130 days.

(21) Appl. No.: 10/640,654

(22) Filed: Aug. 14, 2003

(65) Prior Publication Data

US 2005/0073236 A1 Apr. 7, 2005

(30) Foreign Application Priority Data

Feb. 24, 2003 (KR) ..... 10-2003-0011459

(51) Int. Cl.
*H01J 29/48* (2006.01)
*H01J 29/51* (2006.01)

(52) U.S. Cl. ..... 313/414; 313/449

(58) Field of Classification Search ..... 313/412–141, 313/409, 446–449

See application file for complete search history.

(56) References Cited

U.S. PATENT DOCUMENTS 5,027,043 A 6/1991 Chen et al.
5,061,881 A 10/1991 Suzuki et al.
5,206,561 A * 4/1993 Oh ..... 315/15
5,386,178 A * 1/1995 Son et al. ..... 315/15
5,404,071 A 4/1995 Son
5,936,338 A * 8/1999 Takahashi ..... 313/414
6,489,736 B1 * 12/2002 Ueno et al. ..... 315/382
6,815,881 B1 * 11/2004 Chen et al. ..... 313/414
6,844,665 B1 * 1/2005 Steinhauser et al. ..... 313/414

FOREIGN PATENT DOCUMENTS

CN 1116360 A 2/1996

* cited by examiner

*Primary Examiner*—Mariceli Santiago
*Assistant Examiner*—Anthony Perry
(74) *Attorney, Agent, or Firm*—Birch, Stewart, Kolasch & Birch, LLP

(57) ABSTRACT

An electron gun for a cathode ray tube comprises a triode including a cathode, a control electrode and an accelerating electrode, a pre-focusing electrode unit adjacent to the triode, a main lens unit including a focusing electrode and an anode for forming a main lens for focusing the electron beam toward a screen, a first focusing electrode unit having vertically-elongated electron beam passing holes and horizontally-elongated electron beam passing holes for forming a quadrupole lens, a second focusing electrode unit having vertically-elongated electron beam passing holes and horizontally-elongated electron beam passing holes for forming a quadrupole lens, and an auxiliary electrode disposed between the first focusing electrode unit and the second focusing electrode unit, to which a dynamic voltage is applied, and including vertically-elongated electron beam passing holes on electron beam incoming side thereof and horizontally-elongated electron beam passing holes on electron beam outgoing side thereof.

24 Claims, 16 Drawing Sheets

ELECTRON GUN FOR CATHODE RAY TUBE

This nonprovisional application claims priority under 35 U.S.C. § 119 (a) on patent application Ser. No. 2003-0011459 filed in Korea on Feb. 24, 2003, which is herein incorporated by reference.

BACKGROUND OF THE INVENTION

1. Field of the Invention

The present invention relates to an electron gun for a cathode ray tube, and particularly, to an electron gun for a cathode ray tube that is capable of improving an image quality of a screen by optimizing a shape of an electron beam by correcting an aberration according to a deflection angle of the electron beam.

2. Description of the Background Art

Generally, a cathode ray tube, which optically implements an image by converting an electric signal into an electron beam and discharging the electron beam onto a phosphor screen, is widely used since excellent display quality is achieved at an affordable price.

As shown in FIG. 1, the cathode ray tube includes: a panel 11 of a front glass; a funnel 16 of a rear glass forming a vacuum space by being coupled with the panel 11; a phosphor screen 15 deposited on an inner surface of the panel 11 and serving as a phosphor; an electron gun 1 for emitting electron beams 13 which makes the phosphor screen 15 emit light; a deflection yoke 12 mounted on an outer circumferential surface of the funnel 16 with a predetermined interval for deflecting the electron beam 13 to the phosphor screen 15; a shadow mask 14 installed at a constant interval from the phosphor screen 15; a mask frame 18 for fixing and supporting the shadow mask 14; an inner shield 19 extending from the panel 11 to the funnel 16 for shielding external terrestrial magnetism and thus preventing deterioration of color purity by the magnetism; and a holder 17 for elastically supporting the mask frame 18 to an inner side of the panel 11.

In the conventional cathode ray tube, the electron beam 13 emitted from the electron gun 1 is deflected by the deflection yoke 12, passes through a plurality of electron beam passing holes formed at the shadow mask 14, and lands on the phosphor screen 15 deposited on the inner surface of the panel 11. Accordingly, the deflected electron beam 6 makes the phosphor formed at the phosphor screen 15 emit light, thereby achieving an image.

Hereinafter, the electron gun 1 of the conventional cathode ray tube will be described with reference to FIG. 2.

The electron gun 1 can be divided into a triode and a main lens unit according to operations.

The triode comprises a cathode 3, in which a heater 2, thermal source is built in for discharging thermal electron, and arranged in-line; a control electrode 4 for controlling thermal electron discharged from the cathode 3; and an accelerating electrode 5 for accelerating the electron beam 13. Herein, the control electrode 4 is grounded, and a low voltage of 500V~1000V is applied to the accelerating electrode 5.

The main lens unit comprises a focusing electrode 8 for focusing the electron beam 13 emitted from the triode and an anode 9 for finally accelerating the electron beam. High voltage of 25~35 KV is applied to the anode 9, and middle voltage about 20~30% of the voltage applied to the anode 9 is applied to the convergent electrode 8.

Therefore, a static electron lens is formed between the anode 9 and the focusing electrode 8 due to potential difference between voltages applied to the anode 9 and to the convergent electrode 8 so that the electron beam 13 is focused toward the phosphor screen 15.

Also, the focusing electrode 8 comprises a first focusing electrode 8*a* adjacent to the triode and a second focusing electrode 8*b* adjacent to the anode 9. Further, a static voltage is applied to the first focusing electrode 8*a*, and dynamic voltage is applied to the second focusing electrode 8*b*. Therefore, a quadrupole (hereinafter, referred to as quadrupole lens) is formed between the first focusing electrode 8*a* and the second focusing electrode 8*b*.

Meanwhile, reference numerals 6, 7 indicate focusing electrodes for focusing the electron beam 13 emitted from the triode.

Hereinafter, the quadrupole lens will be described as follows.

That is, in order to realize the image, the electron beams 13 should land on the proper areas of the phosphor screen 15, and therefore, the electrode beams 13 should be deflected to the whole area of the screen 15. Generally, since the electron beams of red, green and blue colors are arranged in parallel in the cathode ray tube using the in-line type electron gun 1, a self-convergence deflection yoke 12 using inhomogeneous electromagnetic field is used in order to focus the respective electron beams 13 on one point of the screen 15. In the distribution of the electric field generated by the self-convergence deflection yoke 12, horizontal deflection electromagnetic field is applied by a pincushion type, and vertical deflection electromagnetic field is applied by a barrel type as shown in FIGS. 3A and 3B. Therefore, as shown in FIGS. 4A and 4B, there are dipolar component and quadrupolar component. The dipolar component deflects the electron beam toward horizontal and vertical directions, and the quadrupolar component converges the electron beam in the vertical direction and diverges in the horizontal direction, and therefore, the beam in vertical direction is converged with shorter distance than that of the horizontal direction to cause a halo phenomenon that the electron beam is risen bulgingly in the vertical direction on periphery of the screen. That is, as shown in FIG. 5, since the deflected electric field of the deflection yoke is not applied on the center portion of the screen 15, electron beam spot has an exact shape. However, the deflected electric field of the deflection yoke 12 is applied on the periphery of the screen 15, and therefore, the electron beam 13 is diverged in the horizontal direction and converged in the vertical direction. Therefore, the shape of the electron beam spot is formed as a horizontally elongated core shape of high density in the horizontal direction, and a halo, which is an inflected form of low density, is generated in the vertical direction to cause the inferiority of the screen resolution on the periphery of the screen. These problems become worse as the cathode ray tube grows larger and the deflection angle of the electron beam becomes larger.

Therefore, in order to solve the above problems, the quadrupolar lens is formed between the first focusing electrode 8*a* and the second focusing electrode 8*b* as shown in FIG. 6 to compensate with the quadrupolar component generated from the deflection yoke 12, and thereby, the electron beam components of the horizontal and the vertical directions can be focused on one point at the same time. However, the electron beam 13 is focused before reaching to the screen 15 due to the difference between the distance from the electron gun 1 to the center of the screen 15 and the distance from the electron gun 1 to the periphery of the screen 15, and the halo phenomenon is still generated. Therefore, in order to improve these problems, a dynamic voltage synchronized with the deflection signal of the deflection yoke 12 is applied in order to reduce the lens magnification of the main lens, and therefore, a focal length of the electron beam is reduced to compensate aberration of the main lens when the electron beam is deflected toward the periphery of the screen 15.

However, according to the conventional dynamic focus electron gun applying the quadrupolar lens generated by applying the dynamic voltage to the electrode, very high dynamic voltage is required in order to compensate entirely the halo phenomenon of the electron beam on the periphery of the screen. In addition, in case that the electron beam is deflected to the periphery of the screen, the vertical size of the electron beam spot becomes too small and the horizontal size of the spot becomes relatively large. Therefore, a moire phenomenon that the shape of the electron beam spot is shown as a waveform is generated on the screen, and consequently the screen resolution of the periphery of the screen is lowered.

SUMMARY OF THE INVENTION

Therefore, an object of the present invention is to provide an electron gun for a cathode ray tube which is able to improve an image quality by compensating an aberration according to a deflection angle of an electron beam to optimize shape of the electron beam.

To achieve the object of the present invention, as embodied and broadly described herein, there is provided an electron gun for a cathode ray tube including: a triode including a cathode, a control electrode and an accelerating electrode; a pre-focusing electrode unit adjacent to the triode; a main lens unit including a focusing electrode and an anode for forming a main lens for focusing the electron beam toward a screen; a first focusing electrode unit having vertically-elongated electron beam passing holes and horizontally-elongated electron beam passing holes for forming a quadrupole lens; a second focusing electrode unit having vertically-elongated electron beam passing holes and horizontally-elongated electron beam passing holes for forming a quadrupole lens; and an auxiliary electrode disposed between the first focusing electrode unit and the second focusing electrode unit, to which a dynamic voltage is applied, and including vertically-elongated electron beam passing holes on electron beam incoming side thereof and horizontally-elongated electron beam passing holes on electron beam outgoing side thereof.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
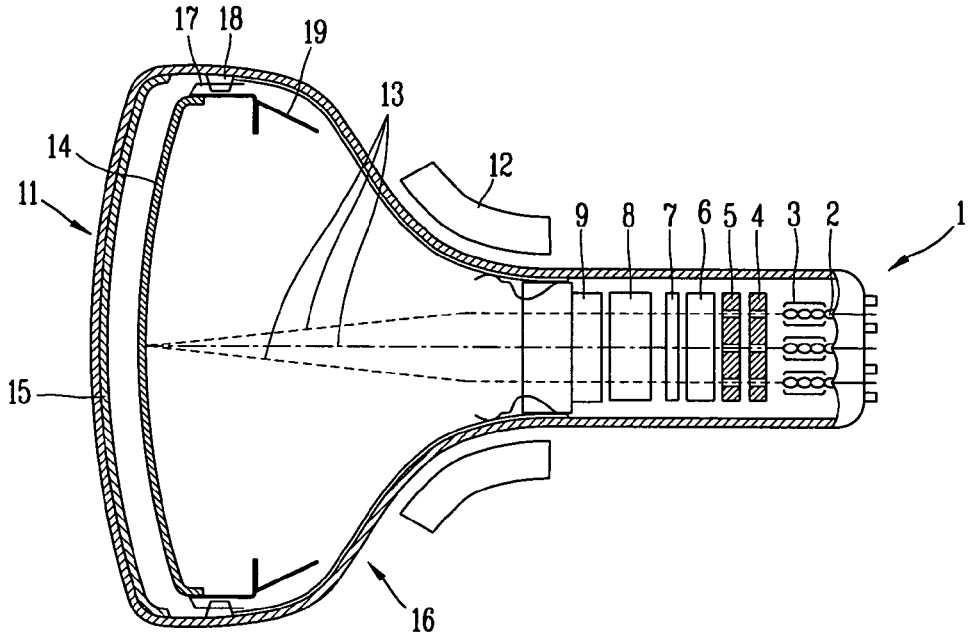
FIG. 1 CONVENTIONAL ART
FIG. 1 is a schematic view showing a structure of a general cathode ray tube.
Figure 2:
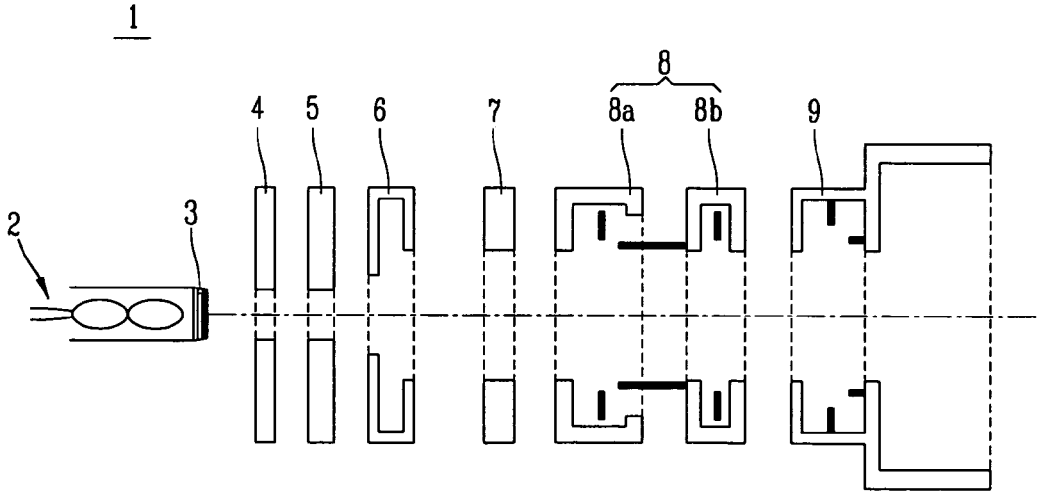
FIG. 2 CONVENTIONAL ART
FIG. 2 is a schematic view showing a structure of an electron gun of the conventional cathode ray tube.
Figure 3A:
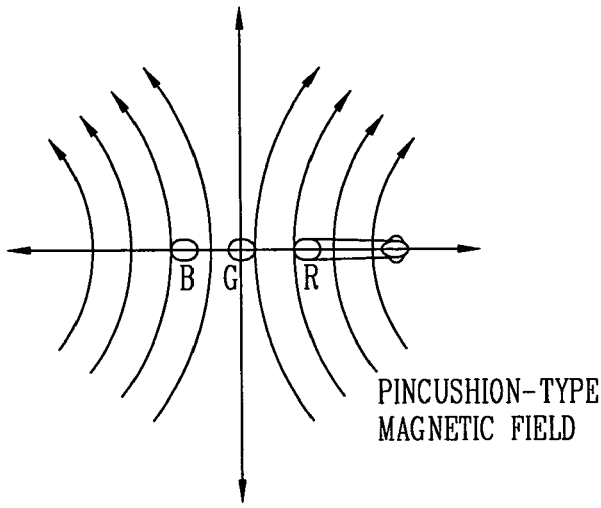
FIG. 3A CONVENTIONAL ART
FIGS. 3A and 3B are views showing a pincushion type electric field and a barrel type electric field generated by a deflection yoke.
Figure 3B:
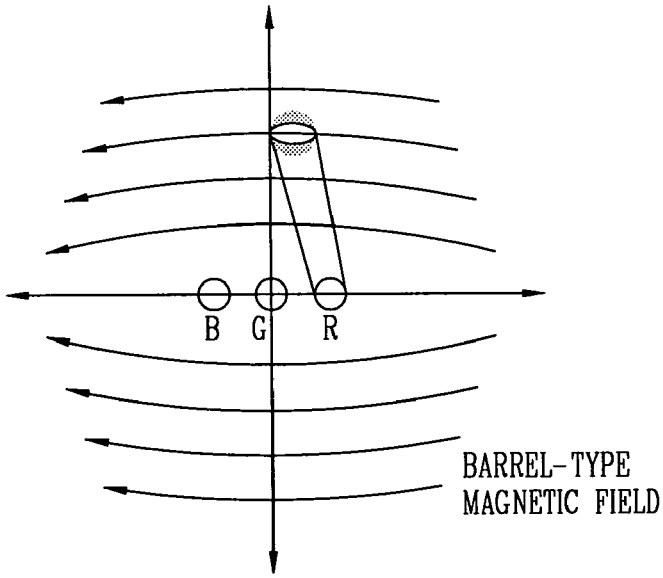
FIG. 3B CONVENTIONAL ART
Figure 4A:
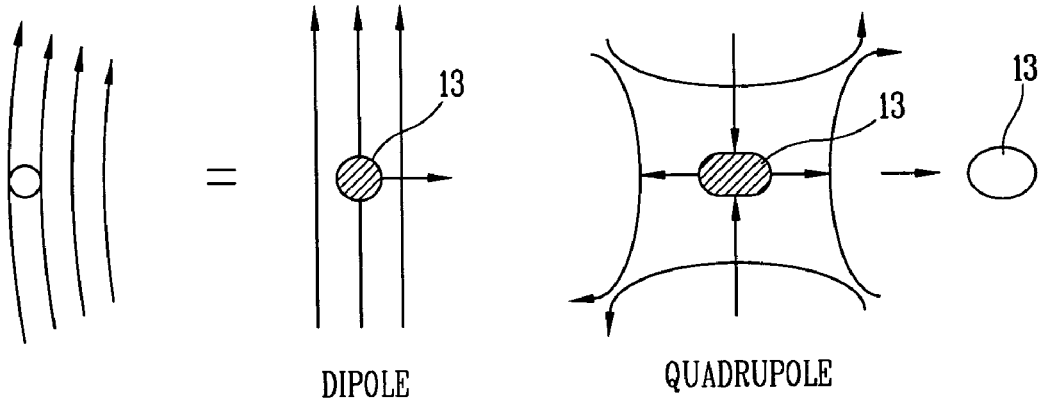
FIG. 4A CONVENTIONAL ART
FIGS. 4A and 4B are views showing affect to the electron beam by the pincushion type electric field and the barrel type electric field generated from the deflection yoke.
Figure 4B:
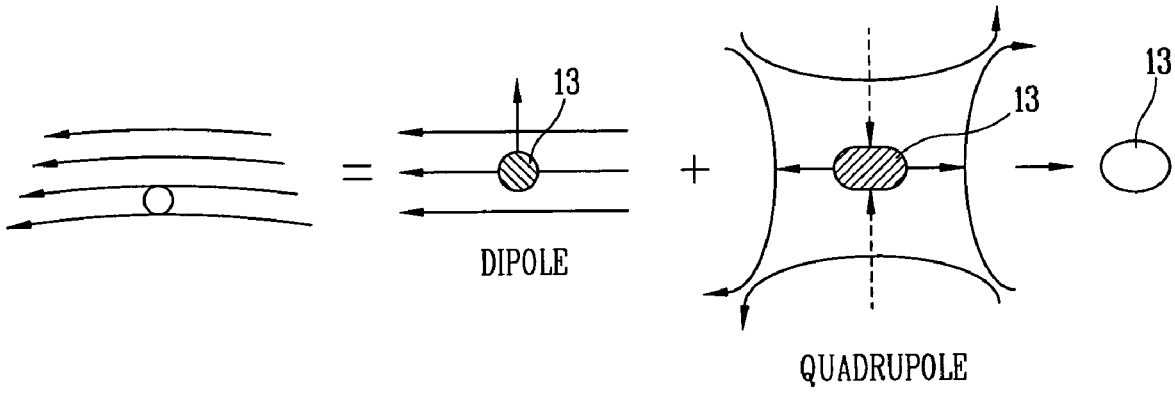
FIG. 4B CONVENTIONAL ART
Figure 5:
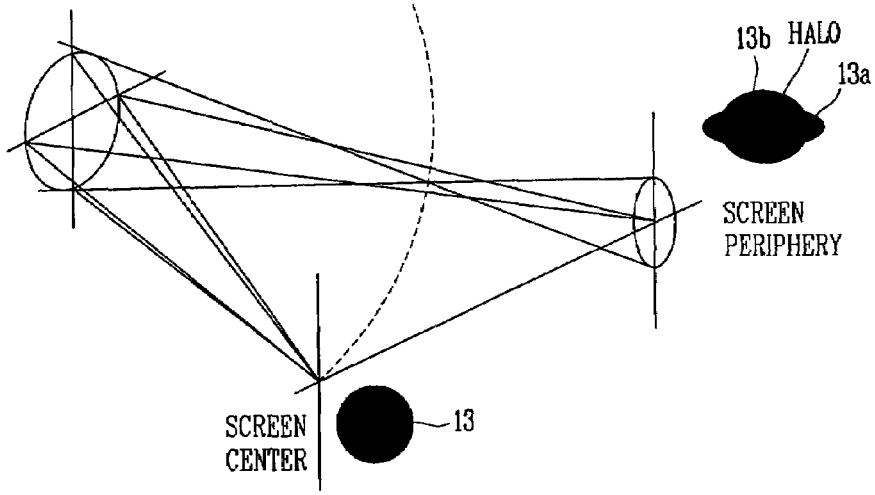
FIG. 5 CONVENTIONAL ART
FIG. 5 is a view showing a shape of electron beam spot due to a difference between distances from the electron gun to a center of a screen and to a periphery of a screen of the conventional cathode ray tube.
Figure 6:
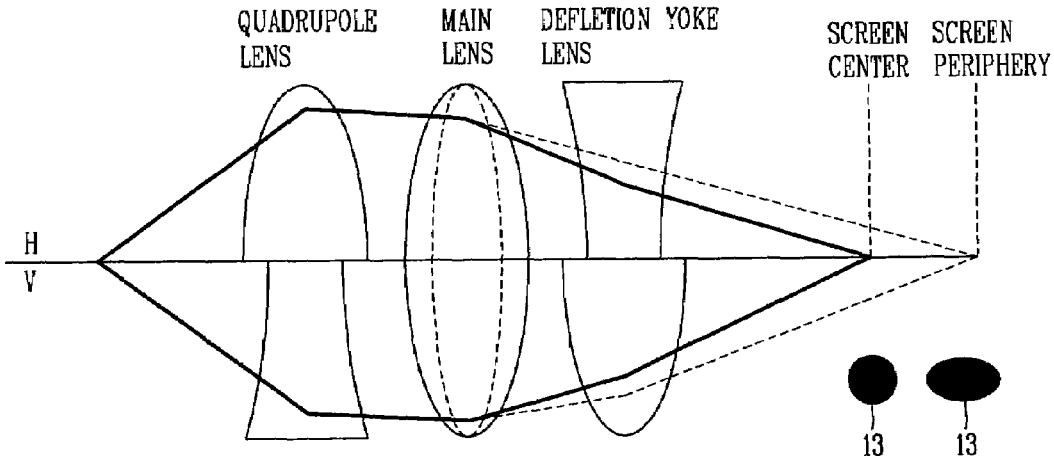
FIG. 6 CONVENTIONAL ART
FIG. 6 is a view showing electric fields distribution of a quadrupole lens, a main lens and a deflection yoke lens by the electron gun of the conventional cathode ray tube and affect to the electron beam by the electric fields.
Figure 7A:
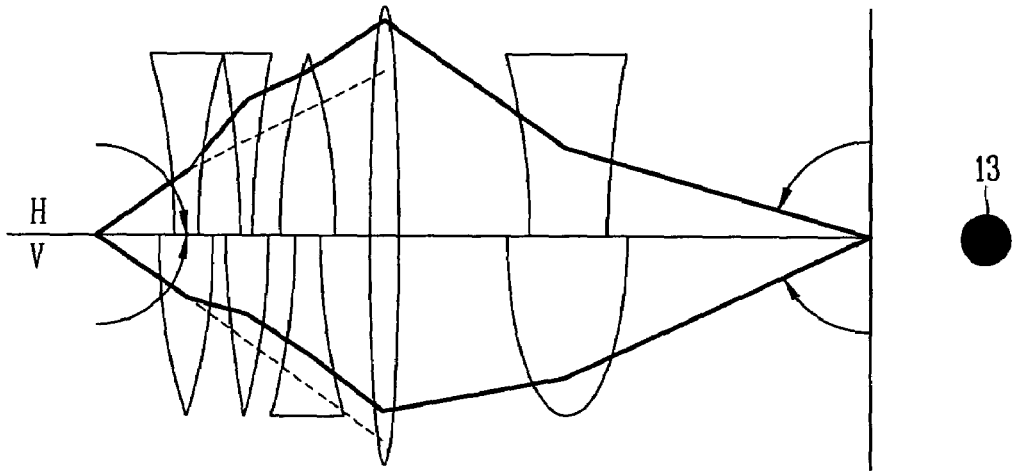
FIGS. 7A and 7B are views showing electric fields distribution of a quadrupole lens, a main lens and a deflection yoke lens by the electron gun of the conventional cathode ray tube and affect to the electron beam by the electric fields according to the present invention.

FIG. 7A is a view showing the structure of quadrupole lenses formed in an electron gun of a cathode ray tube according to the present invention, as combining quadrupole lenses respectively performing horizontally divergent action and vertically convergent action and quadrupole lenses respectively performing horizontally convergent action and vertically divergent action, between a triode and a main lens.

A magnification of the lens will be described with the following Lagrange-Helmholts equation, the operational principle of the present invention which will be described later.

$$M=(\alpha o/\alpha i)\times(Vo/Vi)^2 \quad (1)$$

Herein, M represents magnification of the lens, $\alpha i$ is an incoming angle of the electron beam, $\alpha o$ is an outgoing angle of the electron beam, Vi is a voltage which is applied to an incoming side of an electrode, and Vo is a voltage which is applied to an outgoing side of an electrode.

As shown in equation (1), when the incoming angle ($\alpha i$) of the electron beam is increased, the magnification (M) of the lens is reduced, and therefore, a size of the electron beam spot on the screen is reduced. In addition, when the incoming angle ($\alpha i$) of the electron beam is reduced, the magnification (M) of the lens is increased, and therefore, the size of the electron beam spot on the screen is increased.

Accordingly, in case that the structure meant by the above equation (1) is applied to the electrode adjacent to the triode, and especially, the shape of the electron beam can be formed in complete shape even when an electron beam is deflected toward the periphery of the screen.

In order to solve the problem in the conventional electron gun that very high dynamic focus voltage is required to compensate the intense electromagnetic filed of the deflection yoke lens when the electron beam is deflected toward the periphery of the screen, it requires that the vertical diameter of the electron beam incoming on the deflection yoke lens is reduced. Also, it requires the horizontal diameter of the electron beam incoming on a dynamic focusing electrode is increased.

However, operation of the electrode for horizontally elongating the electron beam incoming on the electrode which a dynamic focus voltage is applied is very weak in the conventional electron gun, and therefore, the dynamic focus voltage is risen and the incoming angle ($\alpha i$) of the electron beam in the vertical direction is increased, and thereby, the vertical diameter of the electron beam is extremely reduced in case that the electron beam is deflected on the periphery of the screen.

In the present invention, the structure for horizontally elongating the electron beam outgoing from the triode and for vertically elongating the electron beam incoming on the main lens is applied, using the principle of the Lagrange-Helmholts equation.

Also, the lens magnification of the quadrupole lens adjacent to the triode should be larger than that of the quadrupole lens adjacent to the main lens to prevent the screen resolution from deteriorating due to the reducing the vertical diameter of the electron beam when the electron beam is deflected toward the periphery of the screen.

The present invention relates to the electrode forming the quadrupole lens, and comprises the structures for horizontally elongating the electron beam outgoing from the triode and for vertically elongating the electron beam incoming on the main lens.

Figure 7B:
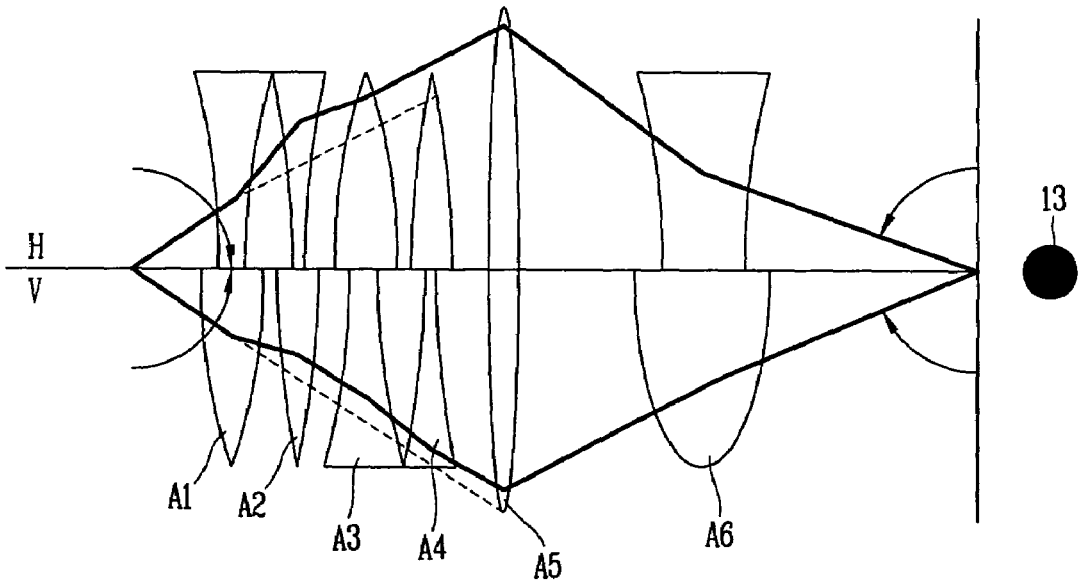

That is, as shown in FIG. 7B, a first quadrupole lens A1 and a second quadrupole lens A2 for horizontally elongating and vertically shrinking the diameter of the electron beam are formed to be adjacent to the triode. In addition, a third quadrupole lens A3 and a fourth quadrupole lens A4 for horizontally shrinking and vertically elongating the diameter of the electron beam are formed to be adjacent to the main lens A5. Here, a reference numeral A6 indicates the deflection yoke lens.

FIG. 8A through 8E are brief views showing a structure of the electron gun of the cathode ray tube according to an embodiment of the present invention, that plate shaped electrodes respectively forming the quadrupole lenses are inserted between the conventional electrodes for intensifying the electromagnetic field of the quadrupole lenses so as to compensate the deflection yoke lens when the electron beam is deflected toward the periphery of the screen.

Figure 8A:
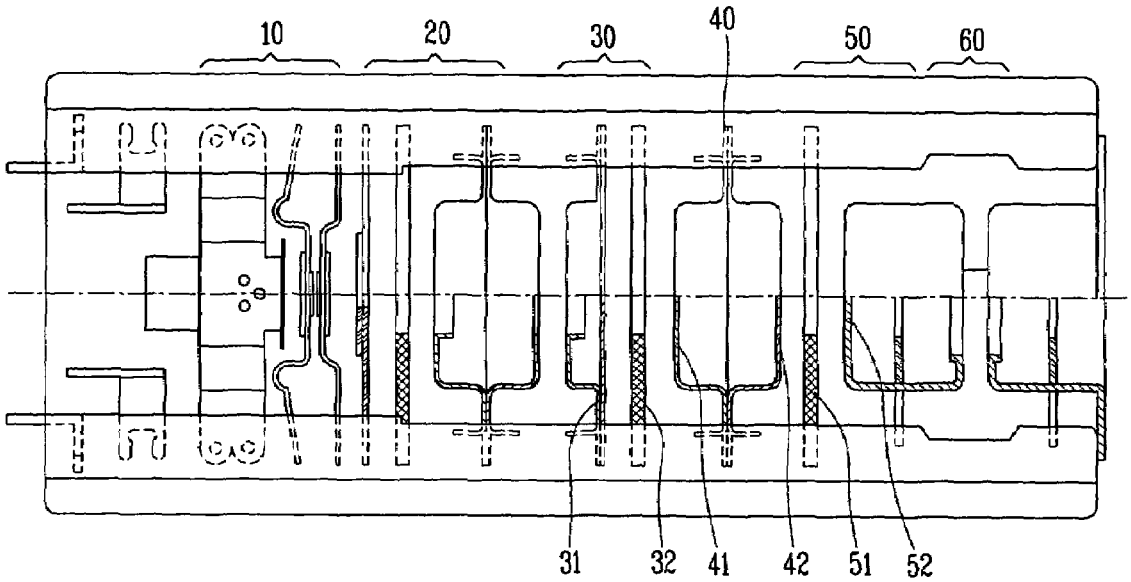
FIGS. 8A, 8B, 8C, 8D and 8E are brief views showing a structure of an electron gun for the cathode ray tube according to the present invention.
Figure 8B:
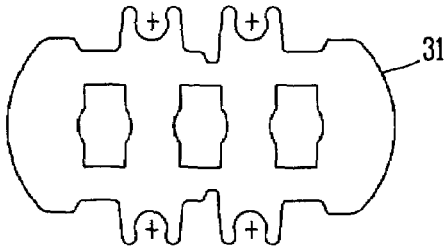
Figure 8C:
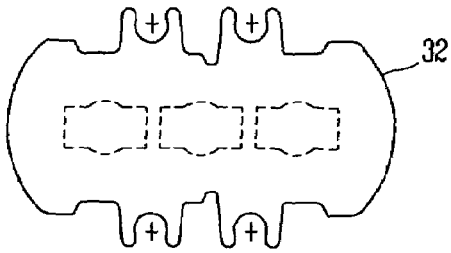
Figure 8D:
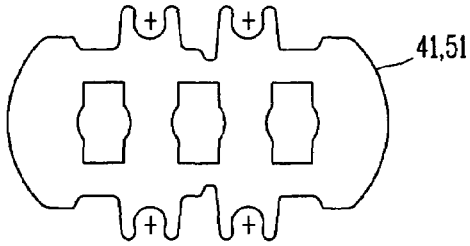
Figure 8E:
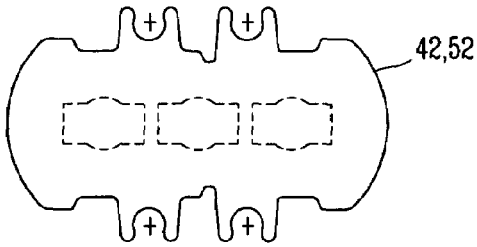
Figure 9A:
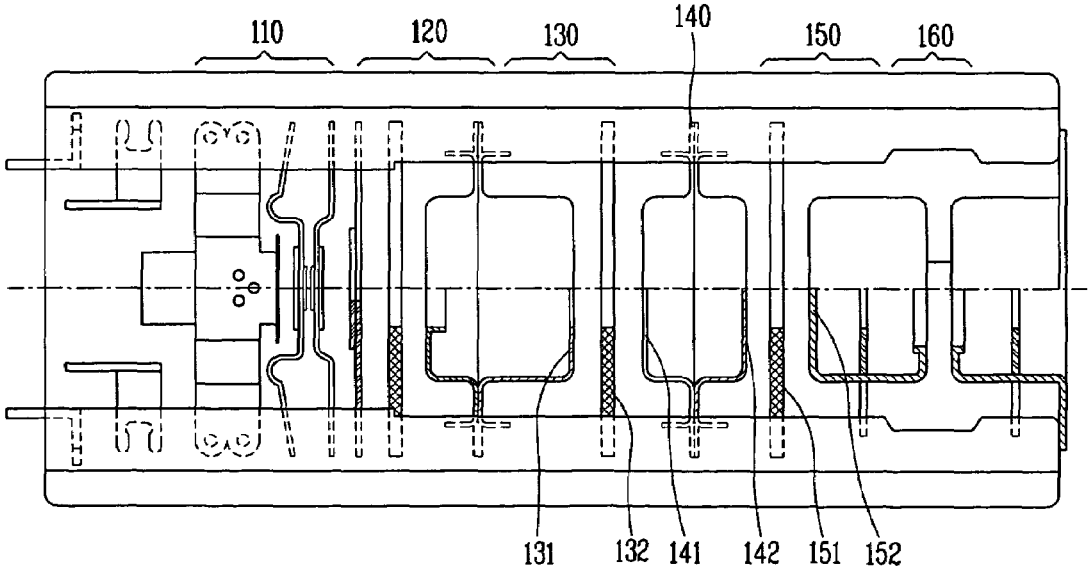
FIGS. 9A, 9B, 9C, 9D and 9E are brief views showing a structure of an electron gun for the cathode ray tube according to another embodiment of the present invention.
Figure 9B:
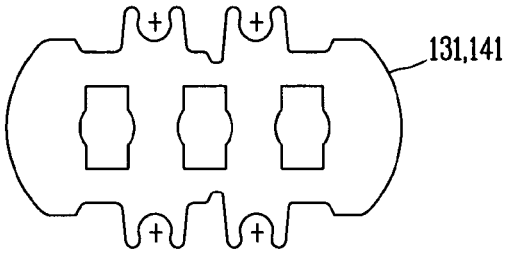
Figure 9C:
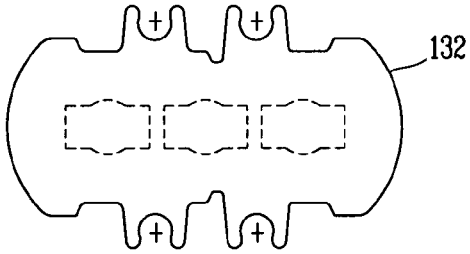
Figure 9D:
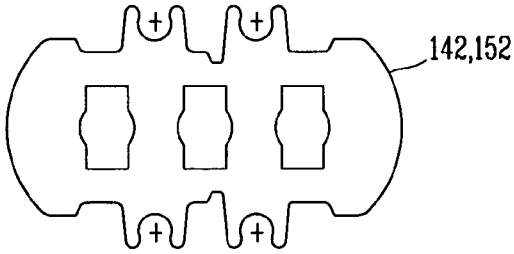
Figure 9E:
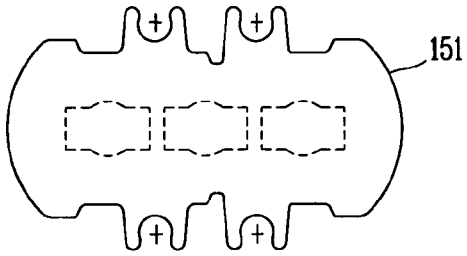

As shown in FIGS. 8A and 8E, the electron gun of the cathode ray tube according to an embodiment of the present invention comprises: a triode 10 including cathodes, a control electrode, and an accelerating electrode; pre-focusing electrode unit 20 adjacent to the triode 10 for focusing the electron beam; a main lens unit 60 including an anode and a focusing electrode for forming a main lens for focusing the electron beam toward a screen; a first focusing electrode unit 30 having vertically-elongated electron beam passing holes and horizontally-elongated electron beam passing holes for forming a quadrupole lens therebetween; a second focusing electrode unit 50 having vertically-elongated electron beam passing holes and horizontally-elongated electron beam passing holes; an auxiliary electrode 40 disposed between the first focusing electrode unit 30 and the second focusing electrode unit 50, to which a dynamic voltage is applied, and including vertically-elongated electron beam passing holes on electron beam incoming side 41 thereof and horizontally elongated electron beam passing holes on electron beam outgoing side 42 thereof.

The first focusing electrode unit 30 comprises a first dynamic focusing electrode 31 adjacent to the pre-focusing electrode unit 20 and formed as a cup or a cap shape, and a first static focusing electrode 32 adjacent to the auxiliary electrode 40 and formed as a plate shape.

Here, vertically-elongated electron beam passing holes are provided on the electron beam outgoing side of the first dynamic focusing electrode 31, horizontally-elongated electron passing holes are provided on the first static focusing electrode 32. Also, a dynamic focus voltage synchronized with the deflection signal of the deflection yoke is applied to the first dynamic focusing electrode 31, and a static focus voltage is applied to the first static focusing electrode 32. Therefore, the first quadrupole lens A1 performing horizontally divergent action and vertically convergent action is formed between the first dynamic focusing electrode 31 and the first static focusing electrode 32.

The second focusing electrode unit 50 comprises a second dynamic focusing electrode 52 adjacent to the main lens unit 60 and formed as a cup or cap shape, and a second static focusing electrode 51 adjacent to the auxiliary electrode 40 and formed as a plate shape.

Here, horizontally-elongated electron beam passing holes are provided on the electron beam incoming side of the second dynamic focusing electrode 52, and vertically-elongated electron passing holes are provided on the second static focusing electrode 51. Also, a dynamic focus voltage synchronized with the 10 deflection signal of the deflection yoke is applied to the second dynamic focusing electrode 52, and a static focus voltage is applied to the second static focusing electrode 51. Therefore, the fourth quadrupole lens A4 performing horizontally convergent action and vertically divergent action is formed between the second dynamic focusing electrode 52 and the second static focusing electrode 51.

Also, the dynamic focus voltage is applied to the auxiliary electrode 40. Therefore, the second quadrupole lens A2 performing horizontally divergent action and vertically convergent action is formed between the first static focusing electrode 32 and the electron beam incoming side 41 of the auxiliary electrode 40. Also, the third quadrupole lens A3 performing horizontally convergent action and vertically divergent action is formed between the electron beam outgoing side 42 of the auxiliary electrode 40 and the second static focusing electrode 51.

Therefore, the electron gun of the cathode ray tube constructed as above according to the present invention is able to obtain the quadrupole lenses shown in FIG. 7B.

On the other hand, as the deflection action of the deflection yoke is intensified, that is, when the electron beam is deflected toward the periphery of the screen, the lens magnification of the quadrupole lens adjacent to the triode 10 should be larger than that of the quadrupole lens adjacent to the main lens unit 60 to increase the horizontally convergent action and the vertically divergent action to the electron beam around the periphery of the screen.

Therefore, it is desirable that a sum of horizontal widths of the electron beam passing holes on the electrodes applied by the dynamic focus voltage is smaller than a sum of the vertical widths of the electron beam passing holes on the electrodes applied by the static focus voltage so that the lens magnifications of the first and second quadrupole lenses A1 and A2 can be larger than those of the third and fourth quadrupole lenses A3 and A4.

Also, the first and second static focusing electrodes 31 and 51 are formed as the plate shape, and therefore, the quadrupole lenses can be formed and fabricated without mechanical limitation such as size increase of the electron gun.

FIGS. 9A through 9E are views showing a structure of the electron gun according to another embodiment of the present invention, and this embodiment can be applied in case that high dynamic voltage is not required in the general cathode ray tube.

The electron gun of the cathode ray tube according to the another embodiment of the present invention comprises: a triode 110 including a cathode, a control electrode and an accelerating electrode; pre-focusing electrode unit 120 adjacent to the triode 110 for focusing the electron beam; a main lens unit 160 including an anode and a focusing electrode for forming a main lens for focusing the electron beam toward a screen; a first focusing electrode unit 130 having vertically-elongated electron beam passing holes and horizontally-elongated electron beam passing holes for forming a quadrupole lens therebetween; a second focusing electrode unit 150 having vertically-elongated electron beam passing holes and horizontally-elongated electron beam passing holes; an auxiliary electrode 140 disposed between the first focusing electrode unit 30 and the second focusing electrode unit 150, to which a dynamic voltage is applied, and including vertically-elongated electron beam passing holes on electron beam incoming side 141 thereof and horizontally elongated electron beam passing holes on electron beam outgoing side 142 thereof.

The first focusing electrode unit 130 comprises a first dynamic focusing electrode 131 adjacent to the pre-focusing electrode unit 120 and formed as a cup or a cap shape, and a first static focusing electrode 132 adjacent to the auxiliary electrode 140 and formed as a plate shape.

Here, vertically-elongated electron beam passing holes are provided on an electron beam outgoing side of the first dynamic focusing electrode 131, horizontally elongated electron passing holes are provided on the first static focusing electrode 132. Also, a dynamic focus voltage synchronized with the deflection signal of the deflection yoke is applied to the first dynamic focusing electrode 131, and a static focus voltage is applied to the first static focusing electrode 132. Therefore, the first quadrupole lens A1 performing horizontally divergent action and vertically convergent action is formed between the electron beam outgoing side of the first dynamic focusing electrode 131 and the first static focusing electrode 132.

The second focusing electrode unit 150 comprises a second dynamic focusing electrode 152 adjacent to the main lens unit 160 and formed as a cup or cap shape, and a second dynamic focusing electrode 141 adjacent to the auxiliary electrode 140 and formed as a plate shape.

Here, horizontally-elongated electron beam passing holes are provided on the electron beam incoming side of the second dynamic focusing electrode 152, and vertically-elongated electron passing holes are provided on the second static focusing electrode 151. Also, a dynamic focus voltage synchronized with the deflection signal of the deflection yoke is applied to the second dynamic focusing electrode 152, and a static focus voltage is applied to the second static focusing electrode 151. Therefore, the fourth quadrupole lens A4 performing horizontally convergent action and vertically divergent action is formed between the electron beam incoming side of the second dynamic focusing electrode 152 and the second static focusing electrode 151.

Also, the dynamic focus voltage is applied to the auxiliary electrode 140. Therefore, the second quadrupole lens A2 performing horizontally divergent action and vertically convergent action is formed between the first static focusing electrode 132 and the electron beam incoming side 141 of the auxiliary electrode 140. Also, the third quadrupole lens A3 performing horizontally convergent action and vertically divergent action is formed between the electron beam outgoing side 142 of the auxiliary electrode 140 and the second static focusing electrode 151.

Therefore, the electron gun of the cathode ray tube constructed as above according to another embodiment of the present invention is able to obtain the quadrupole lenses shown in FIG. 7B.

Figure 10A:
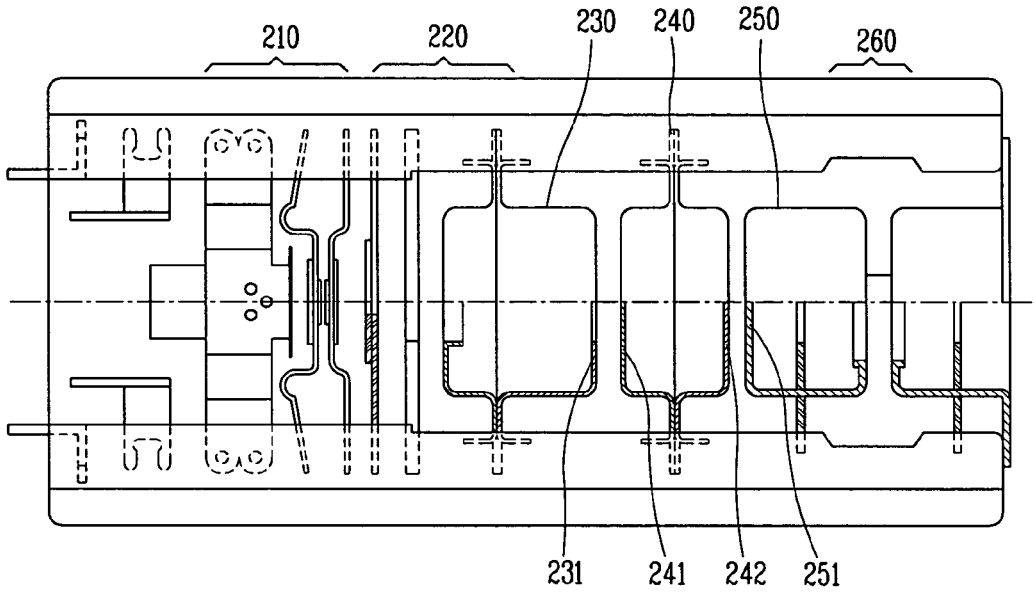
FIGS. 10A, 10B, 10C are brief views showing a structure of an electron gun for the cathode ray tube according to still another embodiment of the present invention.
Figure 10B:
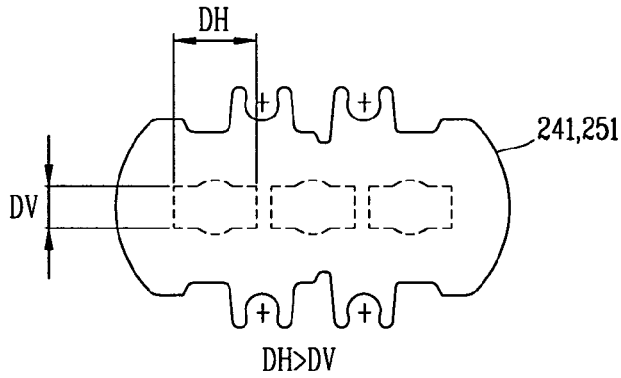
Figure 10C:
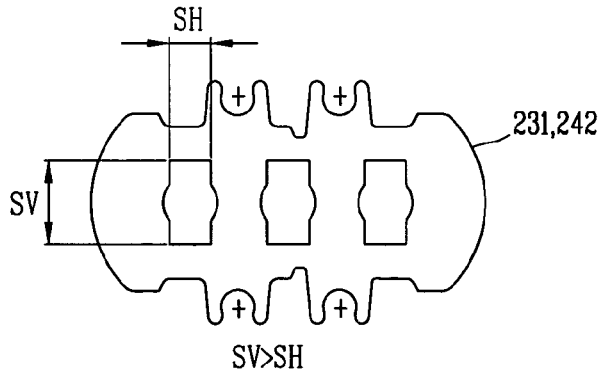

FIGS. 10A, 10B and 10C are brief views showing a structure of an electron gun according to still another embodiment of the present invention, and the plate shaped electrode is not applied, but the mechanical size is increased.

The electron gun for the cathode ray tube according to still another embodiment of the present invention comprises: a triode 210 including a cathode, a control electrode and an accelerating electrode; pre-focusing electrode unit 220 adjacent to the triode 210 for focusing the electron beam; a main lens unit 260 including an anode and a focusing electrode for forming a main lens for focusing the electron beam toward a screen; a first focusing electrode 230 having vertically-elongated electron beam passing holes on an electron beam outgoing side 231 thereof; a second focusing electrode 250 having horizontally-elongated electron beam passing holes on an electron beam incoming side 251 thereof; and an auxiliary electrode 240 disposed between the first focusing electrode 230 and the second focusing electrode 250 and having horizontally-elongated electron beam passing holes on electron beam incoming side 241 thereof and vertically-elongated electron beam passing holes on electron beam outgoing side 242 thereof.

The first and second focusing electrodes 230, 250 are formed as a cup or a cap shape. The dynamic focus voltage synchronized with the deflection signal of the deflection yoke is applied to the first and second focusing electrodes 230, 250. Also, the static focus voltage is applied to the auxiliary electrode 240. Therefore, the quadrupole lens performing horizontally divergent action and vertically convergent action is formed between the electron beam outgoing side 231 of the first focusing electrode 230 and the electron beam incoming side 241 of the auxiliary electrode 240. In addition, the quadrupole lens performing horizontally convergent action and vertically divergent action is formed the electron beam outgoing side 242 of the auxiliary electrode 240 and the electron beam incoming side 251 of the second focusing electrode 250.

On the other hand, in the electron gun of the cathode ray tube according to the still another embodiment of the present invention, as the deflection action becomes larger, that is, when the electron beam is deflected toward the periphery of the screen, the lens magnification of the quadrupole lens adjacent to the triode should be larger than that of the quadrupole lens adjacent to the main lens to improve the horizontally convergent action and the vertically divergent action on the periphery of the screen. Therefore, it is desirable that a sum of horizontal widths of the electron beam passing holes on the electrodes applied by the dynamic voltage is smaller than a sum of the vertical widths on the electrodes applied by the static voltage. That is, it is desirable that an aspect ratio (DH/DV) of the electron beam passing hole formed in the electron beam outgoing side 241 of the auxiliary electrode 240 is smaller than an aspect ratio (SV/SH) of the electron beam passing hole formed in the electron beam outgoing side 231 of the first focusing electrode 230.

Hereinafter, the performance and effects of the electron gun in accordance with the cathode ray tube will be described, as follows.

Figure 11:
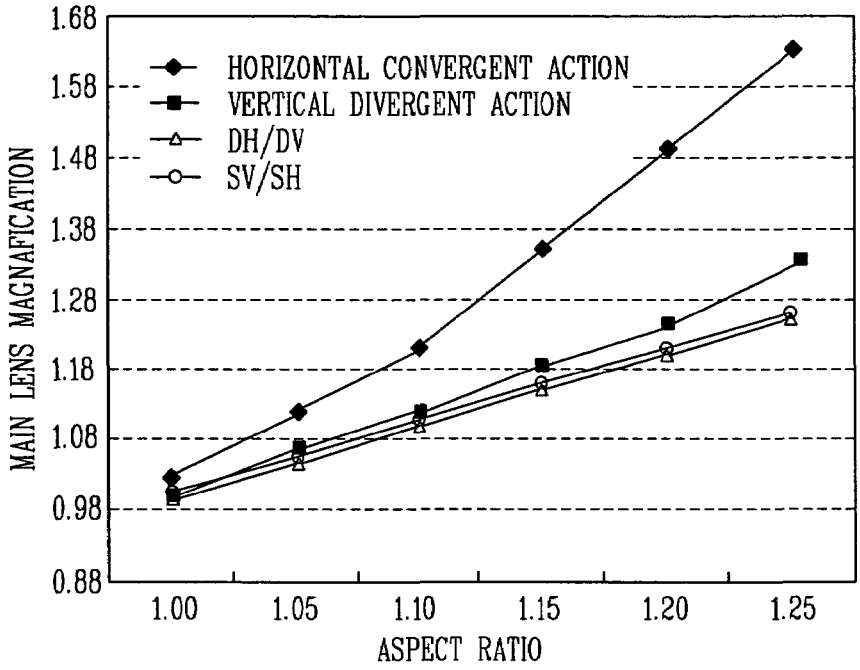
FIG. 11 is a graph showing a difference between horizontally convergent action and vertically divergent action according to increase of an aspect ratio between length and width in case that the difference between the aspect ratios between length and width of a dynamic electrode and a static electrode is small, in the electron gun of the cathode ray tube.
Figure 12:
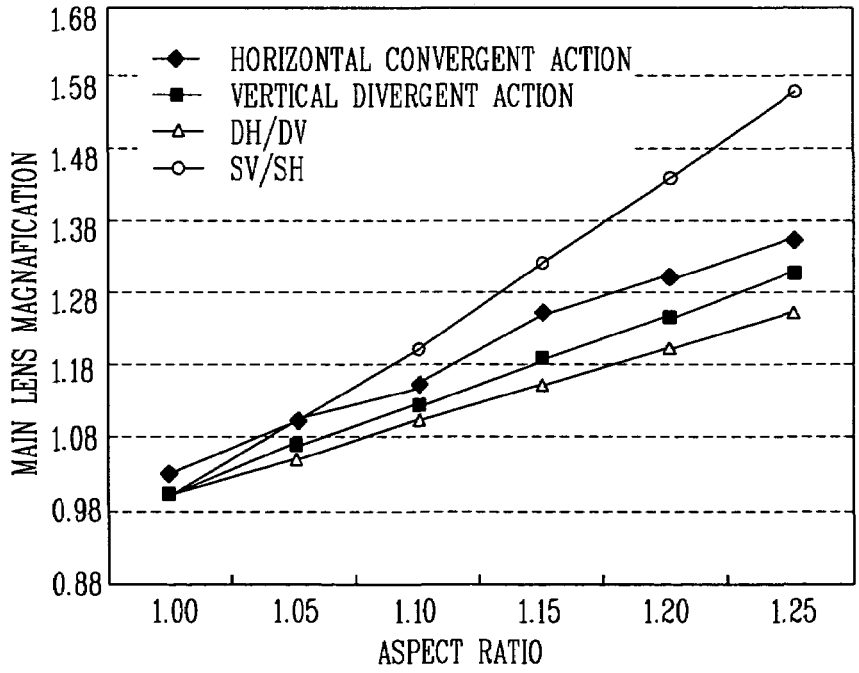
FIG. 12 is a graph showing a difference between horizontally convergent action and vertically divergent action according to increase of an aspect ratio between length and width in case that the difference between the aspect ratios between length and width of a dynamic electrode and a static electrode is large, in the electron gun of the cathode ray tube.

FIG. 11 is a graph showing a relation between horizontally convergent action and vertically divergent action according to change of an aspect ratio between vertical and horizontal widths of the electron beam passing hole, in case that the difference between the aspect ratios of a dynamic focusing electrode and a static focusing electrode is small; and FIG. 12 is a graph showing a relation between horizontally convergent action and vertically divergent action according to change of an aspect ratio between vertical and horizontal widths of the electron beam passing hole, in case that the difference the aspect ratios of a dynamic focusing electrode and a static focusing electrode is large.

As shown in FIG. 11, in case that the aspect ratio (DH/DV) of the dynamic focusing electrode is similar to the aspect ratio (SV/SH) of the static focusing electrode, the vertically divergent action is larger than the horizontally convergent action, and there is remarkable difference between the vertically divergent action and the horizontally convergent action. In this case, a serious halo phenomenon is generated in the horizontal direction at the periphery of the screen, and the screen resolution on the periphery of the screen is deteriorated.

However, as shown in FIG. 12, in case that there is large difference between the aspect ratio (DH/DV) of the dynamic focusing electrode and the aspect ratio (SV/SH) of the static focusing electrode, the vertically divergent action and the horizontally convergent action are similar to each other. In this case, the deterioration of the screen resolution can be compensated when the electron beam is deflected toward the periphery of the screen. Therefore, it is desirable that a sum of horizontal widths of the electron beam passing holes on the electrodes applied by the dynamic voltage is smaller than that of the vertical widths of the electron beam passing holes on the electrodes applied by the static voltage.

Figure 13:
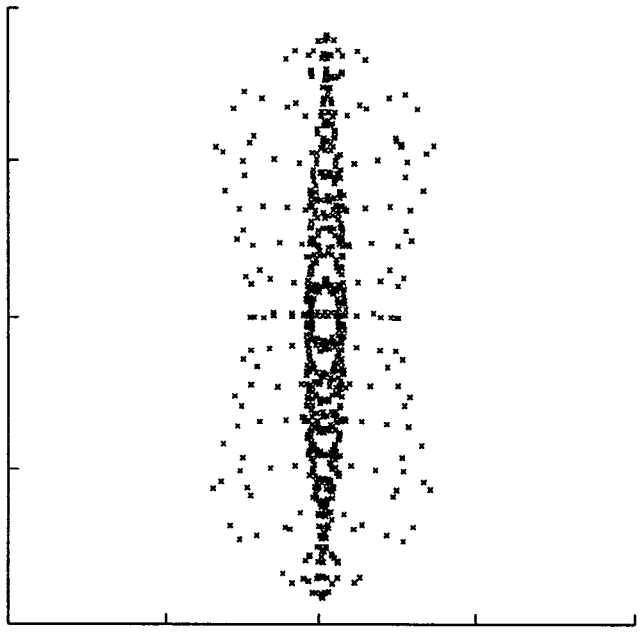
FIG. 13 is a view showing a shape of the electron beam on periphery of the screen in case that the difference between the aspect ratios of length and width of the dynamic electrode and the static electrode is small, in the electron gun of the cathode ray tube.
Figure 14:
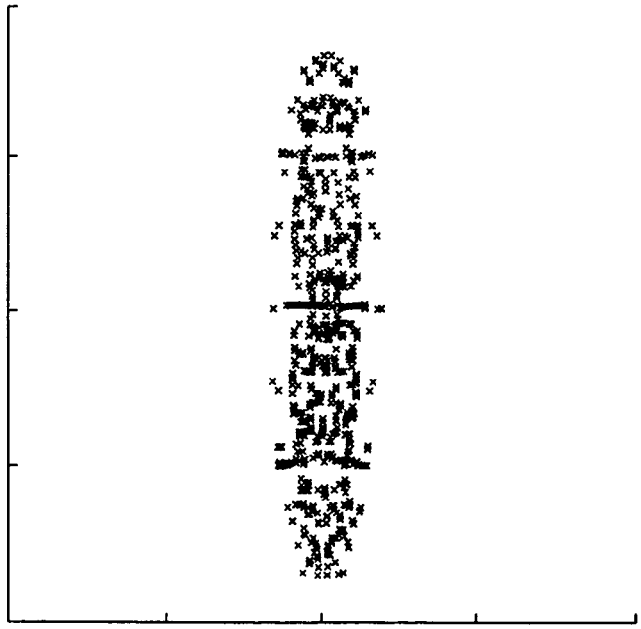
FIG. 14 is a view showing a shape of the electron beam on a periphery of the screen in case that the difference between the aspect ratios of length and width of the dynamic electrode and the static electrode is large, in the electron gun of the cathode ray tube.

On the other hand, FIG. 13 shows a result of simulation representing the electron beam shape for FIG. 11. A lot of halo phenomena are generated on the periphery of the screen by the intense horizontally convergent action, as shown therein. Also, FIG. 14 shows a result of simulation representing the electron beam shape for FIG. 12, and the halo is rarely shown in the horizontal direction.

Figure 15:
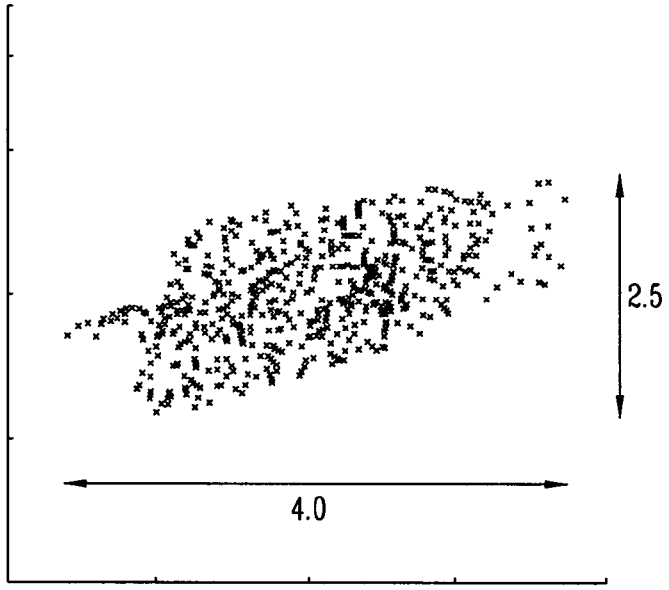
FIG. 15 is a view showing a shape of the electron beam on the periphery of the screen in case that a magnifying power of the quadrupole lens adjacent to a triode lens is larger than that of the quadrupole lens adjacent to the main lens, in the electron gun of the cathode ray tube.
Figure 16:
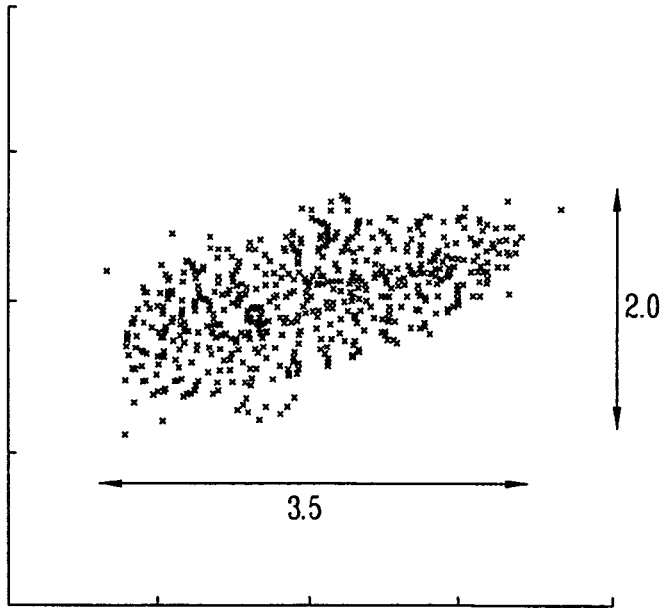
FIG. 16 is a view showing a shape of the electron beam on the periphery of the screen in case that a magnifying power of the quadrupole lens adjacent to a triode lens is similar to that of the quadrupole lens adjacent to the main lens, in the electron gun of the cathode ray tube.

FIG. 15 is a result of analyzing the simulation of electron beam on the periphery of the screen. In case that the lens magnification of the quadrupole lens adjacent to the triode is more intense than that of the quadrupole lens adjacent to the main lens, the horizontally convergent action of the electron beam is strong and the size of electron beam in the vertical direction on the periphery of the screen is not reduced. In addition, FIG. 16 shows a result of analyzing electron beam simulation on the periphery of the screen. In case that the lens magnification of the quadrupole electrode adjacent to the main lens is coincided with that of the quadrupole electrode adjacent to the triode, the entire size of the electron beam in the horizontal and vertical directions is reduced due to the convergent action coincidence in the horizontal and vertical directions and the halo is also removed. Therefore, the lens magnification of the quadrupole lens adjacent to the triode should be larger than that of the quadrupole lens adjacent to the main lens in order to improve the horizontally convergent action and the vertically divergent action when the electron beam is deflected toward the periphery of the screen.

FIGS. 17 through 24 show diameters and loci of the electron beam before the electron beam is incoming on the main lens in the cases that the dynamic voltage is applied and is not applied, in the electron guns of the conventional art and the present invention.

Figure 17:
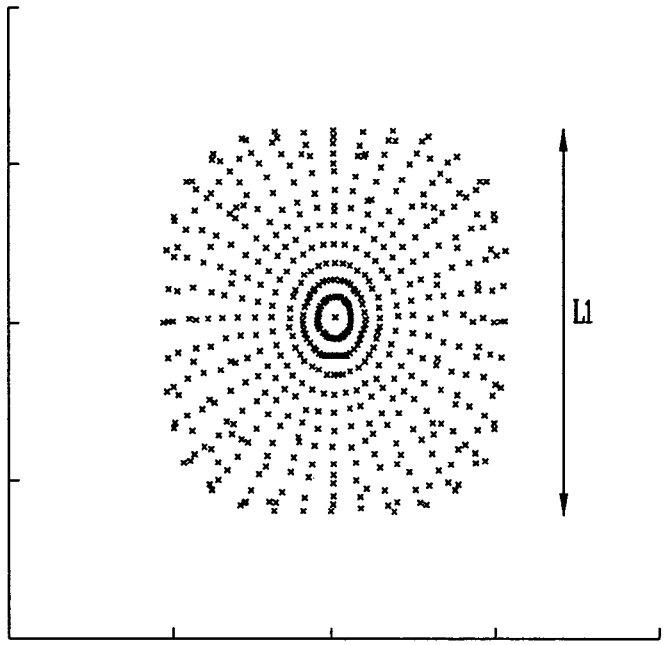
FIG. 17 is a view showing a shape of an electron beam before it is incident into the main lens in case that the dynamic voltage is not applied in the electron gun of the conventional cathode ray tube.
Figure 18:
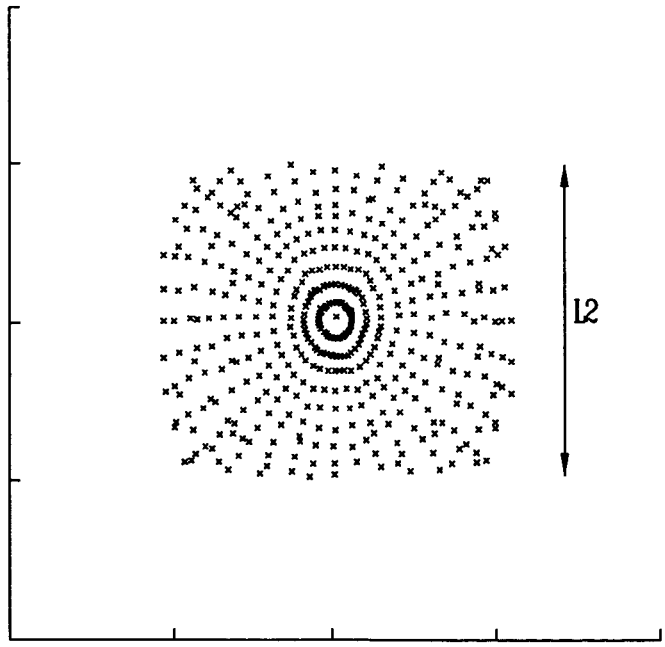
FIG. 18 is a view showing a shape of an electron beam before it is incident into the main lens in case that the dynamic voltage is applied in the electron gun of the conventional cathode ray tube.
Figure 19:
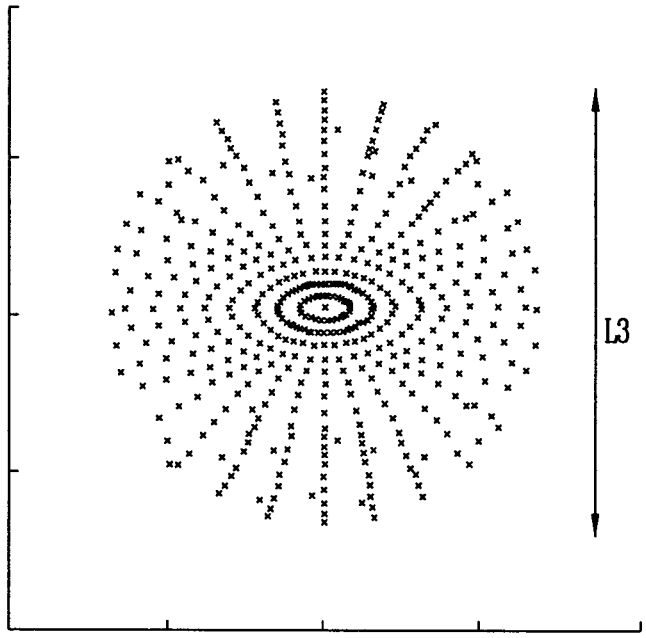
FIG. 19 is a view showing a shape of an electron beam before it is incident into the main lens in case that the dynamic voltage is not applied in the electron gun of the cathode ray tube according to the present invention.
Figure 20:
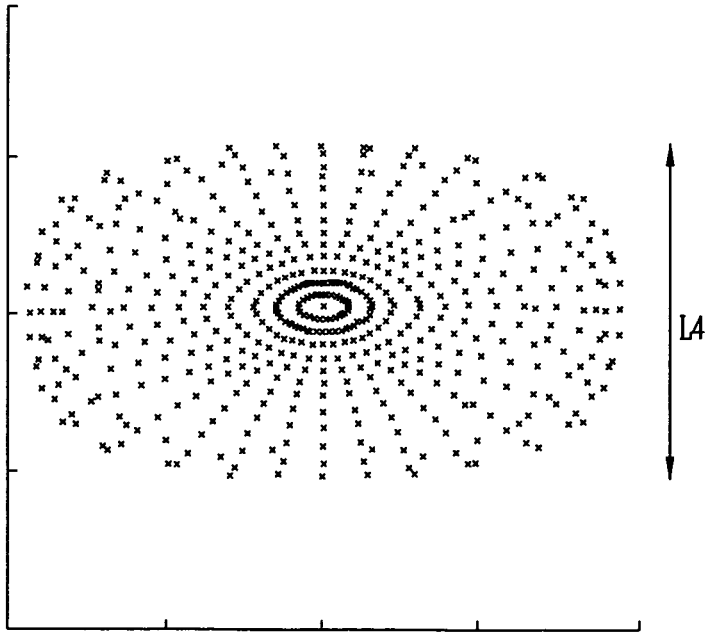
FIG. 20 is a view showing a shape of an electron beam before it is incident into the main lens in case that the dynamic voltage is applied in the electron gun of the cathode ray tube according to the present invention.
Figure 21:
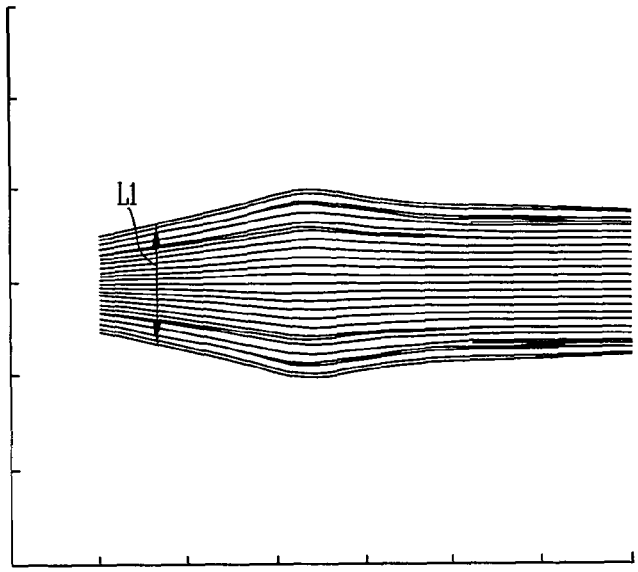
FIG. 21 is a view showing a locus of the electron beam incident into the main lens in case that the dynamic voltage is not applied, in the electron gun of the conventional cathode ray tube.
Figure 22:
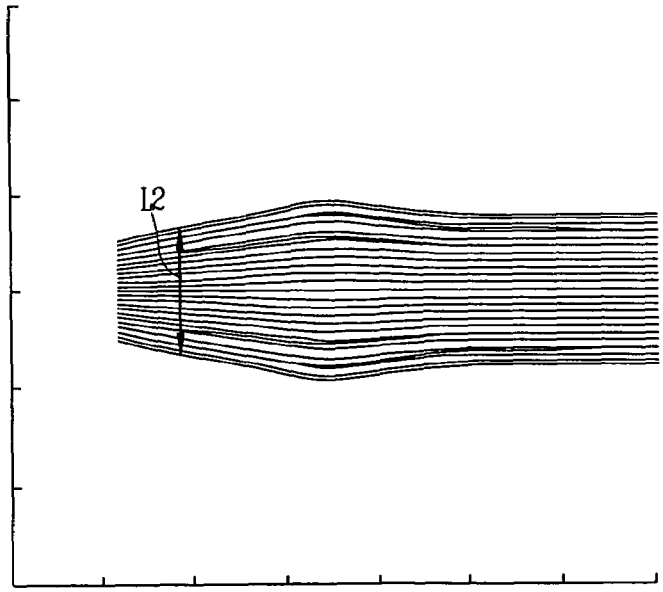
FIG. 22 is a view showing a locus of the electron beam incident into the main lens in case that the dynamic voltage is applied, in the electron gun of the conventional cathode ray tube.
Figure 23:
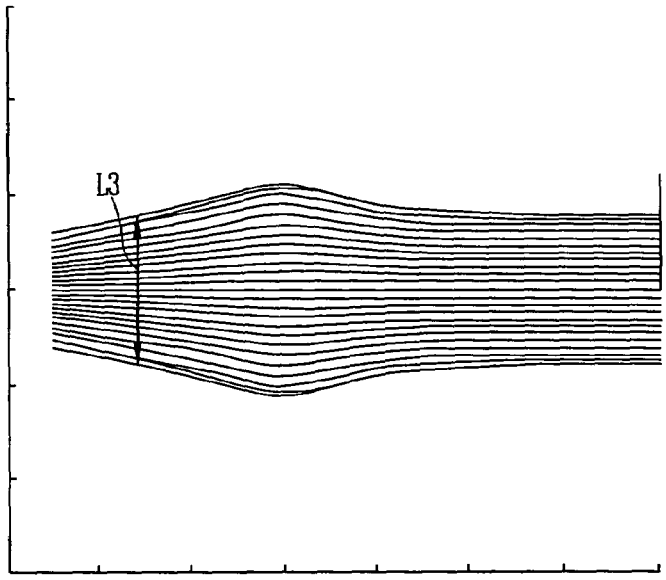
FIG. 23 is a view showing a locus of the electron beam incident into the main lens in case that the dynamic voltage is not applied, in the electron gun of the cathode ray tube according to the present invention.
Figure 24:
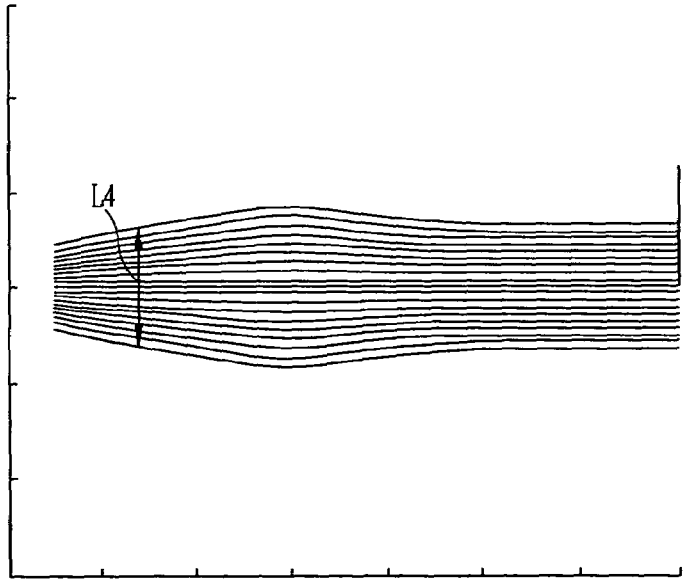
FIG. 24 is a view showing a locus of the electron beam incident into the main lens in case that the dynamic voltage is applied, in the electron gun of the cathode ray tube according to the present invention.

As shown in FIGS. 17 and 18, and in FIGS. 21 and 22, in case of the conventional electron gun, the difference between the diameter (L1) of the electron beam in case that the dynamic voltage is not applied and the diameter (L2) of the electron beam in case that the dynamic voltage is applied before the electron beam is incoming on the main lens is slightly shown. However, as shown in FIGS. 19 and 20, and in FIGS. 23 and 24, the difference between (L3) of the electron beam in case that the dynamic voltage is not applied and the diameter (L4) of the electron beam in case that the dynamic voltage is applied is large according to the electron gun of the present invention, and the electron beam in case that the dynamic voltage is applied is horizontally-elongated comparing to that in case that the dynamic voltage is not applied. Accordingly, in the electron gun of the present invention, in case that the electron beam which is horizontally-elongated before incoming on the main lens passes through the main lens and the deflection yoke lens, the shape of the electron beam can be formed as a complete shape when the electron beam is deflected toward the periphery of the screen.

According to the electron gun of the present invention described above, the electrodes are constructed so that the quadrupole lenses are overlapped to intensify the quadrupole lens effect, and therefore, the screen resolution on the periphery of the screen can be improved and the dynamic voltage can be lowered remarkably.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electron gun for a cathode ray tube comprising:

a triode including a cathode, a control electrode and an accelerating electrode;

a pre-focusing electrode unit adjacent to the triode;

a main lens unit including a focusing electrode and an anode for forming a main lens for focusing the electron beam toward a screen;

a first focusing electrode unit having vertically-elongated electron beam passing holes and horizontally-elongated electron beam passing holes for forming a quadrupole lens;

a second focusing electrode unit having vertically-elongated electron beam passing holes and horizontally-elongated electron beam passing holes for forming a quadrupole lens; and an auxiliary electrode disposed between the first focusing electrode unit and the second focusing electrode unit, to which a dynamic voltage is applied, and including vertically-elongated electron beam passing holes on electron beam incoming side thereof and horizontally-elongated electron beam passing holes on electron beam outgoing side thereof.

2. The electron gun of claim 1, wherein an electrode of the first focusing electrode unit which is adjacent to the auxiliary electrode is formed as a plate shape, and an electrode of the second focusing electrode unit which is adjacent to the auxiliary electrode is formed as a plate shape.

3. The electron gun of claim 2, wherein a static voltage is applied to the electrodes adjacent to the auxiliary electrode.

4. The electron gun of claim 1, wherein horizontally-elongated electron beam passing holes are formed in an electrode of the first focusing electrode unit to which a static voltage is applied.

5. The electron gun of claim 1, wherein vertically-elongated electron beam passing holes are formed in an electrode of the second focusing electrode unit to which a static voltage is applied.

6. The electron gun of claim 5, wherein horizontally-elongated electron beam passing holes are formed in an electrode of the first focusing electrode unit to which a static voltage is applied.

7. The electron gun of claim 6, wherein the first focusing electrode unit is adjacent to the pre-focusing electrode unit, and the second focusing electrode unit is adjacent to the main lens unit.

8. The electron gun of claim 1, wherein the auxiliary electrode is formed as a cup shape or a cap shape.

9. The electron gun of claim 1, wherein a sum of horizontal widths of electron beam passing holes of the first and second focusing electrode units to which a dynamic voltage is applied is smaller than a sum of vertical widths of electron beam passing holes of the first and second focusing electrode units to which a static voltage is applied.

10. The electron gun of claim 1, wherein a magnification of a quadruple lens formed by the first focusing electrode unit is larger than a magnification of a quadruple lens formed by the second electrode unit.

11. The electron gun of claim 1, wherein each electrode of the first focusing electrode unit, the second focusing electrode unit, and the auxiliary electrode receives either a static or a dynamic focus voltage, and a sum of horizontal widths of electron beam passing holes of electrodes on which the dynamic focus voltage is received is less than a sum of vertical widths of electron beam passing holes of electrodes on which the static focus voltage is received.

12. An electron gun for a cathode ray tube comprising:

a triode including a cathode, a control electrode and an accelerating electrode;

a pre-focusing electrode unit adjacent to the triode;

a main lens unit including a focusing electrode and an anode for forming a main lens for focusing the electron beam toward a screen;

a first focusing electrode unit having vertically-elongated electron beam passing holes and horizontally-elongated electron beam passing holes for forming a quadrupole lens, wherein at least one electrode of the first focusing electrode unit is formed as a plate shape;

a second focusing electrode unit having vertically-elongated electron beam passing holes and horizontally-elongated electron beam passing holes for forming a quadrupole lens, wherein at least one electrode of the second focusing electrode unit is formed as a plate shape; and an auxiliary electrode disposed between the first and second focusing electrode units, to which a dynamic voltage is applied, wherein horizontally-elongated electron beam passing holes are formed in an electrode of the first focusing electrode unit, to which a static voltage is applied.

13. The electron gun of claim 12, wherein vertically-elongated electron beam passing holes are formed in an electrode of the second focusing electrode unit, to which a static voltage is applied.

14. The electron gun of claim 13, wherein horizontally-elongated electron beam passing holes are formed in an electrode of the first focusing electrode unit, to which a static voltage is applied.

15. The electron gun of claim 14, wherein the first focusing electrode unit is adjacent to the pre-focusing electrode unit, and the second focusing electrode unit is adjacent to the main lens unit.

16. The electron gun of claim 12, wherein a static voltage is applied to electrodes adjacent to the auxiliary electrode.

17. The electron gun of claim 12, wherein a magnification of a quadruple lens formed by the first focusing electrode unit is larger than a magnification of a quadruple lens formed by the second electrode unit.

18. The electron gun of claim 12, wherein each electrode of the first focusing electrode unit, the second focusing electrode unit, and the auxiliary electrode receives either a static or a dynamic focus voltage, and a sum of horizontal widths of electron beam passing holes of electrodes on which the dynamic focus voltage is received is less than a sum of vertical widths of electron beam passing holes of electrodes on which the static focus voltage is received.

19. An electron gun for a cathode ray tube comprising:

a triode including a cathode, a control electrode and an accelerating electrode;

a pre-focusing electrode unit adjacent to the triode;

a main lens unit including a focusing electrode and an anode for forming a main lens for focusing the electron beam toward a screen;

at least two focusing electrodes disposed between the pre-focusing electrode unit and the main lens unit for forming at least two quadrupole lenses; and an auxiliary electrode disposed between the at least two focusing electrodes and including horizontally-elongated electron beam passing holes on an electron beam incoming side thereof and vertically-elongated electron beam passing holes on an electron beam outgoing side thereof, wherein a static voltage is applied to the auxiliary electrode.

20. The electron gun of claim 19, wherein a dynamic voltage is applied to each of the at least two focusing electrodes adjacent to the auxiliary electrode.

21. The electron gun of claim 19, wherein a first focusing electrode of the at least two focusing electrodes is adjacent to the pre-focusing electrode unit, and has vertically-elongated electron beam passing holes.

22. The electron gun of claim 19, wherein a second focusing electrode of the at least two focusing electrodes is adjacent to the main lens unit, and has horizontally-elongated electron beam passing holes.

23. The electron gun of claim 19, wherein a first focusing electrode of the at least two focusing electrodes is disposed between the pre-focusing electrode and the auxiliary electrode forming a first quadrupole lens, a second focusing electrode of the at least two focusing electrodes is disposed between the auxiliary electrode and the main lens unit forming a second quadrupole lens, and a magnification of the first quadruple lens is larger than a magnification of the second quadruple lens.

24. The electron gun of claim 19, wherein each electrode of the at least two focusing electrodes and the auxiliary electrode receives either a static or a dynamic focus voltage, and a sum of horizontal widths of electron beam passing holes of electrodes on which the dynamic focus voltage is received is less than a sum of vertical widths of electron beam passing holes of electrodes on which the static focus voltage is received.

* * * * *